US010786704B1

(12) United States Patent
Sheta

(10) Patent No.: US 10,786,704 B1
(45) Date of Patent: Sep. 29, 2020

(54) ABDOMINAL FLEXOR ASSIST DEVICE

(71) Applicant: Mostafa Sheta, Henderson, NV (US)

(72) Inventor: Mostafa Sheta, Henderson, NV (US)

( * ) Notice: Subject to any disclaimer, the term of this patent is extended or adjusted under 35 U.S.C. 154(b) by 0 days.

(21) Appl. No.: 16/785,663

(22) Filed: Feb. 10, 2020

(51) Int. Cl.
*A63B 23/02* (2006.01)

(52) U.S. Cl.
CPC ..... *A63B 23/0211* (2013.01); *A63B 23/0233* (2013.01); *A63B 2208/0228* (2013.01)

(58) Field of Classification Search
CPC ..... A63B 23/0211; A63B 23/0233; A63B 2208/0228; A63B 23/00; A63B 23/02–0244; A63B 2023/003–006
See application file for complete search history.

(56) References Cited

U.S. PATENT DOCUMENTS 1,904,039 A * 4/1933 Bruder ..... A61H 7/001 606/240
4,752,067 A * 6/1988 Colonello ..... A63B 21/4039 482/140
5,033,742 A * 7/1991 Johnson ..... A47C 15/006 441/130
5,207,704 A * 5/1993 Shields ..... A47C 20/027 128/845
5,441,473 A * 8/1995 Safani ..... A63B 23/0233 482/130
5,474,513 A * 12/1995 Carlesimo ..... A61F 5/01 482/140
5,545,114 A * 8/1996 Gvoich ..... A63B 21/055 482/123
5,730,688 A * 3/1998 Prusick ..... A63B 23/0211 297/353
5,807,220 A * 9/1998 Allis ..... A63B 23/0211 482/131
5,871,425 A * 2/1999 Gvoich ..... A63B 21/055 482/123
5,882,284 A * 3/1999 Cayne ..... A63B 23/0211 482/123
5,888,181 A * 3/1999 Yeh ..... A63B 23/00 482/131
5,913,757 A * 6/1999 Winters ..... A63B 23/0211 482/123
6,110,194 A * 8/2000 Saber ..... A61H 1/008 5/633
6,312,366 B1 * 11/2001 Prusick ..... A63B 23/0211 482/129

(Continued)

*Primary Examiner* — Andrew S Lo
(74) *Attorney, Agent, or Firm* — Bayramoglu Law Offices LLC

(57) ABSTRACT

An assisted abdominal sit-up device comprising a foam in a lumbosacral assist block, hip elastic straps, abdominal elastic straps and a hip stability pad. During an extension phase of a sit-up cycle, the hip elastic straps become stretched and stores energy and the abdominal elastic straps keep the lumbosacral assist block in close contact with the user's lower back. When pressure is released from the hip elastic straps during a flexion phase of the sit-up cycle, the stored energy will be released from the hip elastic straps to a user's lower back. When the user's lower back rises up from the floor during the flexion phase, the lumbosacral assist block stays in direct contact with the user's lower back. The hip stability pad adapts to the human pelvis and prevents the assisted abdominal sit-up device from moving along a floor.

19 Claims, 11 Drawing Sheets

(56) References Cited

U.S. PATENT DOCUMENTS 6,569,069 B1 * 5/2003 Linares ..... A61H 1/0292 482/140
6,634,999 B2 * 10/2003 Herbst ..... A61H 1/0292 482/140
7,172,539 B1 * 2/2007 Bythewood ..... A63B 23/0211 482/140
7,207,932 B1 * 4/2007 Dean ..... A63B 23/0211 482/140
7,556,594 B2 * 7/2009 Houston ..... A61H 1/0292 482/140
D626,607 S * 11/2010 Kim ..... D21/671
7,824,317 B2 * 11/2010 Nakamura ..... A63B 21/4047 482/111
8,591,388 B2 * 11/2013 Jahns ..... A63B 23/0211 482/140
8,801,640 B2 * 8/2014 Sevy ..... A63B 21/0442 482/131
8,870,727 B2 * 10/2014 Palmer ..... A63B 21/02 128/845
9,017,237 B2 * 4/2015 Araujo ..... A63B 21/00181 482/142
9,526,939 B2 * 12/2016 Longfellow ..... A63B 21/068
10,245,463 B2 * 4/2019 McCarter ..... A63B 21/4039
2002/0098958 A1 * 7/2002 Watnik ..... A63B 23/0211 482/140
2005/0164854 A1 * 7/2005 Felberg ..... A63B 21/0004 482/140
2006/0116251 A1 * 6/2006 Oz ..... A47C 9/002 482/91
2007/0149373 A1 * 6/2007 Dalebout ..... A63B 21/1609 482/142
2009/0177121 A1 * 7/2009 Brandon ..... A63B 21/00196 600/587
2009/0286660 A1 * 11/2009 Nicklas ..... A63B 21/00181 482/121
2010/0197471 A1 * 8/2010 Hayes ..... A63B 6/00 482/140
2011/0207587 A1 * 8/2011 De La Rambelje ..... A63B 21/00047 482/140
2012/0071307 A1 * 3/2012 Russillo ..... A63B 21/0004 482/140
2013/0253582 A1 * 9/2013 Tielve ..... A61H 1/0292 606/240
2013/0324382 A1 * 12/2013 Wilson ..... A61H 7/007 482/142
2014/0378283 A1 * 12/2014 Qiu ..... A63B 26/00 482/142
2015/0031513 A1 * 1/2015 Park ..... A63B 23/0205 482/140
2015/0111709 A1 * 4/2015 Longfellow ..... A63B 21/068 482/140
2018/0133541 A1 * 5/2018 Cooper ..... A63B 21/4037
2018/0178058 A1 * 6/2018 Fano ..... A63B 21/4037
2019/0223632 A1 * 7/2019 Durfee ..... A47C 20/027
2019/0308066 A1 * 10/2019 Rusch ..... A63B 1/00
2020/0016455 A1 * 1/2020 Van Strander ..... A63B 23/0211
2020/0094104 A1 * 3/2020 Graham ..... A61H 1/0292

* cited by examiner

ABDOMINAL FLEXOR ASSIST DEVICE

TECHNICAL FIELD

The present disclosure relates to an assisted abdominal sit-up device. More specifically, the present disclosure relates to a portable, wearable and mechanically assisted abdominal sit-up device.

BACKGROUND

In many professions, sitting for long periods of time is common and may even be required. This long duration of sitting leads to the abdominal muscles not being exercised, flexed or engaged which leads to very weak abdominal muscles and this causes protrusion of the abdominal muscles which can cause lower back problems. Therefore, methods and devices which strengthen the abdominal muscle(s) have been developed.

A very common and traditional method of performing sit-ups to strengthen the abdominal muscle is to use perform unassisted floor sit-ups. These traditional unassisted sit-ups are performed on a floor yoga mat to strengthen the abdominal muscle. However, when these traditional unassisted sit-ups are performed in an unsupported and unassisted manner this can cause a multitude of lower back injuries and also fail to protect the lower back from injuries during sit-up cycles.

One reason lower back injuries occur when performing unassisted sit-ups using a floor yoga mat is that the first fifteen degrees of an angle (i.e. the angle is measured from the floor up to a vertical axis which is perpendicular to the floor) between the mat/floor and a vertical axis perpendicular to the mat/floor, stress is applied to the lower back and spine and does not engage the abdominal muscles. Additionally, the performance of these traditional unassisted sit-ups becomes very difficult and the time performing the sit-up only lasts for a short duration of time. This denies the majority of the population the ability to perform traditional unassisted floor sit-ups to strengthen their abdominal muscles which results in laxity, weakness and protrusion of the abdominal muscle. The protrusion of the abdominal muscle is known generally as a pot belly.

Similarly, other devices such as a static back support device also fail to protect the lower back from injuries during sit-up cycles and can be very complicated and difficult to use, are awkward, are large, are non-wearable, are non-transportable, are very heavy and are expensive. A static back support device fails to provide mechanical assistance during the sit-up cycle and hence, the sit-up cycle is difficult to perform and therefore fails to provide enough assistance to prolong the performance of the sit-up cycles leading to the lack of the benefits of endurance exercise.

Since there is a valuable need in reducing laxity, weakness and protrusion of the abdominal muscles, Applicant has provided a solution to the above problems of weakness, laxity and protrusion of the abdominal muscles by developing an abdominal assisted device which helps individuals perform sit-ups in a safe and easy manner. Moreover, Applicant's disclosed abdominal assisted device prevents injuring the back and spine by maintaining a person's back fifteen degrees above a horizontal plane of the floor when preforming the sit-up exercises. Applicant's abdominal assisted device increasing the performance of the sit-up by increasing the amount of time, and therefore the endurance, an individual can perform sit-up exercises. Since the duration of time performing sit-ups is increased dramatically (e.g. 10 to 30 minutes minimum), this affects the desired adaptation and conditioning of the abdominal muscles leading to the strengthening of the abdominal muscle. Stronger abdominal muscles will subsequently produce tightening of the abdominal wall, resulting in beneficial health, fitness and cosmetic improvements.

SUMMARY

The ultimate purpose of the assisted abdominal sit-up device is to prevent injury of the lower back and assist in making the sit-up endurance exercise much easier and achievable for the segment of population who are unable to perform this exercise without the assistance of Applicant' disclosed invention. In general, the invention is an endurance exercise device which strengthens and conditions the abdominal muscle(s) and prevents injury to the lower back and spine. The device is a durable exercise device that allows an individual to perform sit-ups in any desired location and on any sitting or lying surface. Due to the ergonomic design of the device, performing sit-ups is easy and safe. Since the device is small, wearable and easily transportable, one can exercise anywhere including at home, in an office, outdoors, in a chair, sofa, couch, bed or even in a sitting or lying device in a medical facility. The device has a unique lower back support system. This unique lower back support system makes it easier to perform sit-ups over conventical yoga mats and static back support devices. Additionally, much less effort is needed to perform sit-ups due to the unique lower back support system.

The abdominal assisted device functions as a mechanical device. The abdominal assisted device aims at duplicating and assisting the functionality of the lumbosacral joint (the lower back joint between vertebra L5 and vertebra S1). This lumbosacral joint affects the flexion and extension of the lower back and abdominal muscles to produce the sit-up. Flexion refers to a movement that decreases an angle between two body parts. Therefore, in the context of sit-ups, flexion is decreasing/narrowing the angle between the lower abdominal muscles and the upper thighs at the groin line. Similarly, extension refers to a movement that increases an angle between two body parts. Therefore, in the context of sit-ups, extension is increasing/widening the angle between the lower abdominal muscles and the upper thighs at the groin line.

The abdominal assisted device comprises a deformable material such as a specific type of foam. The foam can be a memory foam and can be a foam that consists mainly of polyurethane and may also have additional additives which increases the foams viscosity and density. The foam can be a viscoelastic polyurethane foam or a low-resilience polyurethane foam (LRPU). The foam cells are open, effectively creating a matrix through which air can move. Newer foams may recover more quickly to their original shape. The foam can be the foam H-40 and H-50 manufactured by the Graco corporation.

The foam is installed within a lumbosacral assist block (L SAB).

Additionally, various additives can be added or blended into the foaming material as necessary. For example, a coloring agent such as a pigment or the like, a chain extender, a filling material such as calcium carbonate or the like, a flame retardant, an antioxidant, an ultraviolet absorbing agent, a light stabilizer, a conductive substance such as carbon black or the like, and an antibacterial agent or the like can be blended in. The blending amount of the various additives is appropriately regulated according the different user's size, weight or other users place of use or needs.

Through the specification, foam has been used to describe, in a uniform manner, the abdominal assisted device and the operation of the abdominal assisted device. However, any material which compresses and deforms when a force is applied thereto and then returns to the deformable materials' original shape when the force is removed/released from the deformable material can be used as the deformable material. When the user extends (stretches) his/her back and abdominal muscles, the foam of the lumbosacral assist block (L SAB) will be compressed and therefore stores energy, due to the pressure exerted on the foam by the lower back muscles during the extension phase of the sit-up cycle. When the user flexes his/her lower back and abdominal muscles, (to narrow the angle between the lower abdominal muscles and the upper thighs at the groin line) pressure is released from the compressed foam of the lumbosacral assist block to the lower back and the released pressure exerts force/pressure on the lower back assisting the rise of the lower back and assisting the lower abdominal muscle in the flexion phase of the sit-up cycle. This is similar to a personal trainer assisting the user to rise up from a recumbent position to a sitting position. This mechanical energy stored and then released from the foam makes performing the sit-up much easier.

The abdominal assisted device additionally comprises hip elastic straps (HES) and abdominal elastic straps (AES) to augment the mechanical assisting value of the abdominal assisted device. During the extension phase of the sit-up cycle, the hip elastic straps (HES) will become extremely stretched and therefore stores energy. When the pressure is released from the hip elastic straps during the flexion phase of the sit-up cycle, the stored energy will be released from the hip elastic straps (HES) to the user's lower back assisting the user to complete the sit-up cycle. During the extension phase of the sit-up cycle, the abdominal elastic straps (AES) will keep the lumbosacral assist block (L SAB) in close contact with the lower back of the user. When the user's lower back rises up from the floor or another surface during the flexion phase of the sit-up cycle, the lumbosacral assist block (L SAB) stays in direct contact with the lower back of the user. Hence, the mechanical preservation of energy storage and energy release improves and maximizes the efficiency of the mechanical value of the abdominal assisted device.

The abdominal assisted device is useable in a bed (instead of the floor) where the contact surface of the bed with the rest of the body is much softer and adaptive.

The abdominal assisted device is useable on a chair, a reclining chair, a sofa, on the floor, on a stool or any equivalent siting or laying device or apparatus in order to affect assisted sit-ups.

The lumbosacral assist block (L SAB) is a highly specific elastic foam block designed with a foam of a specific elasticity and density that allows the block to function as a kinetic energy reservoir unit (KERU). The lumbosacral assist block (L SAB) will store kinetic energy during the extension (stretch) phase of the sit-up cycle (a pro-gravity phase of the motion cycle). This stored kinetic energy in the compressed lumbosacral assist block (L SAB) will be released to assist and augment the user's power to be able to initiate the abdominal flexion phase of the sit-up cycle. The abdominal flexion phase of the sit-up cycle is the most difficult phase of the sit-up cycle because the initial abdominal flexion phase of the sit-up cycle is anti-gravity in nature and requires the user to exert a lot of kinetic energy to be able to overcome gravity (that is pulling himself/herself up). Most users lack this amount of anti-gravity kinetic energy. Therefore, the abdominal assisted device provides sufficient anti-gravity kinetic energy needed to affect the abdominal flexion phase of the sit-up cycle and the lumbosacral assist block (L SAB) releases its stored kinetic energy and expands to assist the user in overcoming gravity and affects the abdominal flexion phase of the sit-up cycle.

The abdominal assisted device also comprises a hip stability pad (HSP). The hip stability pad adapts perfectly to the anatomy of the human pelvis. The hip stability pad provides stability and cushioning during the performance of the sit-up cycle. A coccygeal spot corresponds to the coccyx (tailbone) of an individual and provides cushioning and stability of the user during sit-up cycles. Ischial spots correspond to the ischial tuberosities of the user and provide cushion and stability. The use of the hip stability pad (EPS) will allow optimal performance of the sit-up cycle and prevent any unnecessary loss of the kinetic energy. This will keep the sit-up cycle as mechanically efficient as possible.

BRIEF DESCRIPTION OF THE DRAWINGS

In order to more clearly illustrate the embodiments of the present disclosure, a brief description of the drawings is given below. The following drawings are only illustrative of some of the embodiments of the present disclosure and for a person of ordinary skill in the art, other drawings or embodiments may be obtained from these drawings without inventive effort.

REFERENCE NUMBERS

Figure 1:
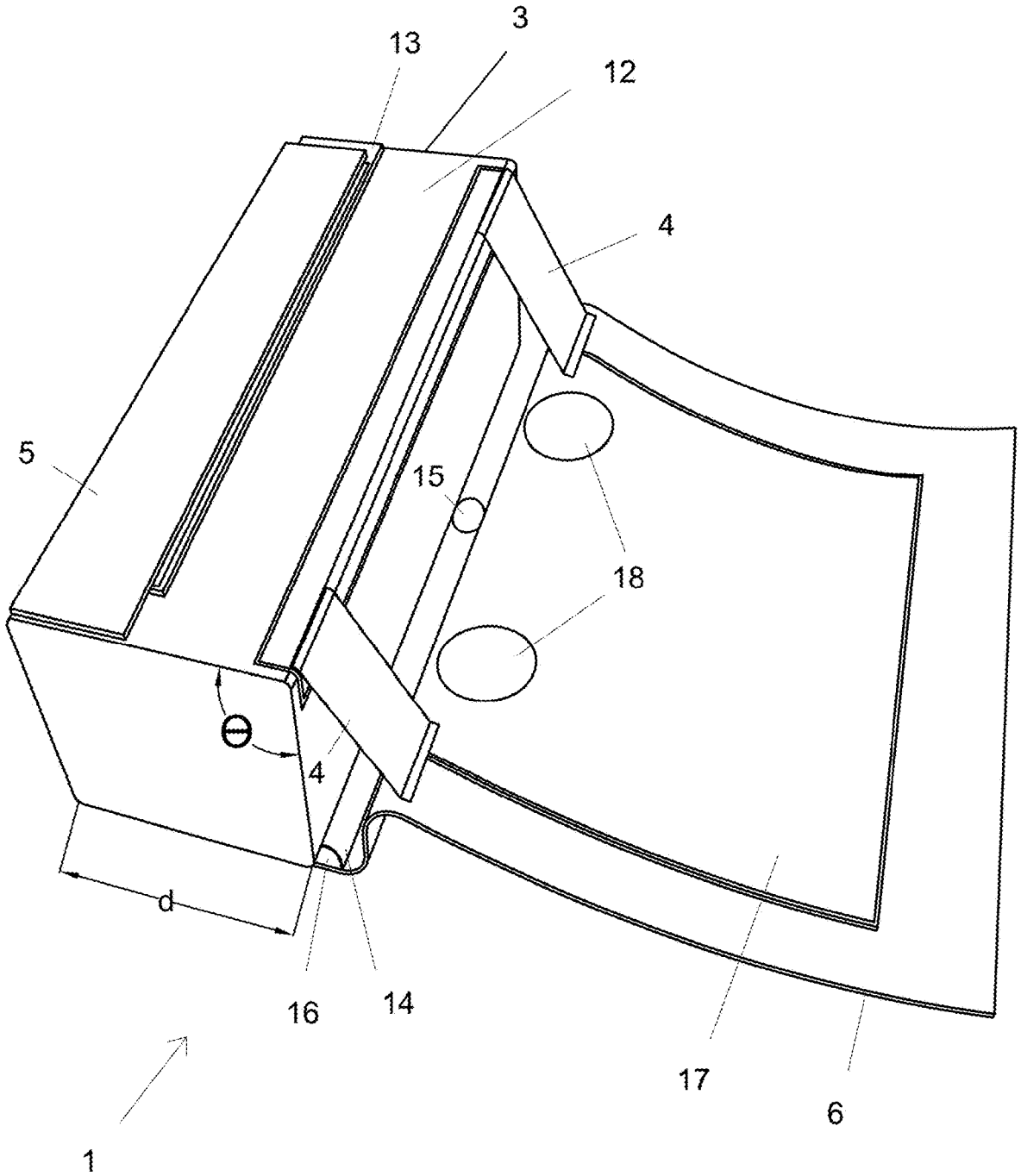
FIG. 1 is a schematic structural diagram of an assisted abdominal sit-up device.

1—assisted abdominal sit-up device; 2—deformable material; 3—lumbosacral assist block; 4—hip elastic straps; 5—abdominal elastic straps; 6—hip stability pad; 7—zipper; 8—corners of the lumbosacral assist block; 9—bottom length of the lumbosacral assist block; 10—flaps; 11—lumbosacral pad; θ—lumbosacral angle; 12—lumbar surface; 13—stability elastic strap; 14—sacrococcygeal device; 15—sacrococcygeal pad; 16—opening; 17—hip pad cushion and 18—ischial supports.

DETAILED DESCRIPTION

The technical solutions of the present disclosure will be clearly and completely described below with reference to the drawings. The embodiments described are only some of the embodiments of the present disclosure, rather than all of the embodiments. All other embodiments that are obtained by a person of ordinary skill in the art on the basis of the embodiments of the present disclosure without inventive effort shall be covered by the protective scope of the present disclosure.

In the description of the present disclosure, it is to be noted that the orientational or positional relation denoted by the terms such as "center", "upper", "lower", "left", "right", "vertical", "horizontal", "inner" and "outer" is based on the orientation or position relationship indicated by the figures, which only serves to facilitate describing the present disclosure and simplify the description, rather than indicating or suggesting that the device or element referred to must have a particular orientation, or is constructed or operated in a particular orientation, and therefore cannot be construed as a limitation on the present disclosure. In addition, the terms "first", "second" and "third" merely serve the purpose of description and should not be understood as an indication or implication of relative importance.

In the description of the present disclosure, it should be noted that unless otherwise explicitly specified and defined, the terms "install", "link" and "connect" shall be understood in the broadest sense, which may, for example, refer to fixed connection, detachable connection or integral connection; may refer to mechanical connection or electrical connection; may refer to direct connection or indirect connection by means of an intermediate medium; and may refer to communication between two elements. A person of ordinary skill in the art would understand the specific meaning of the terms in the present disclosure according to specific situations.

The present disclosure of an assisted abdominal sit-up device 1 is described in detail below in reference to the figures.

FIGS. 1-11 illustrate the present disclosure of an assisted abdominal sit-up device 1.

As shown in FIG. 1, FIG. 2, FIG. 3, FIG. 4, FIG. 9 and FIG. 11, an assisted abdominal sit-up device 1 comprises a deformable material 2 in a lumbosacral assist block 3, hip elastic straps 4, a hip stability pad 6 and a stability elastic strap 14 comprised of abdominal elastic straps 5. The deformable material can be any material which compresses and deforms when a force is applied thereto and then returns to the deformable materials' original shape when the force is removed/released from the deformable material. One type of material is foam.

The assisted abdominal sit-up device 1 is a durable exercise device that allows an individual to perform sit-ups in any desired location and on any sitting or lying surface. Since the assisted abdominal sit-up device 1 is small, lightweight, wearable and easily transportable, one can exercise anywhere including at home, in an office, outdoors, in a chair, reclining chair, sofa, couch, bed, floor, on a stool or any equivalent sitting or lying device or apparatus or even in a sitting or lying device or apparatus in a medical facility in order to perform sit-ups.

The weight of the assisted abdominal sit-up device 1 is in the range of one pound to two pounds. However, the weight of the assisted abdominal sit-up device 1 can be less than one pound or more than two pounds.

Figure 2:
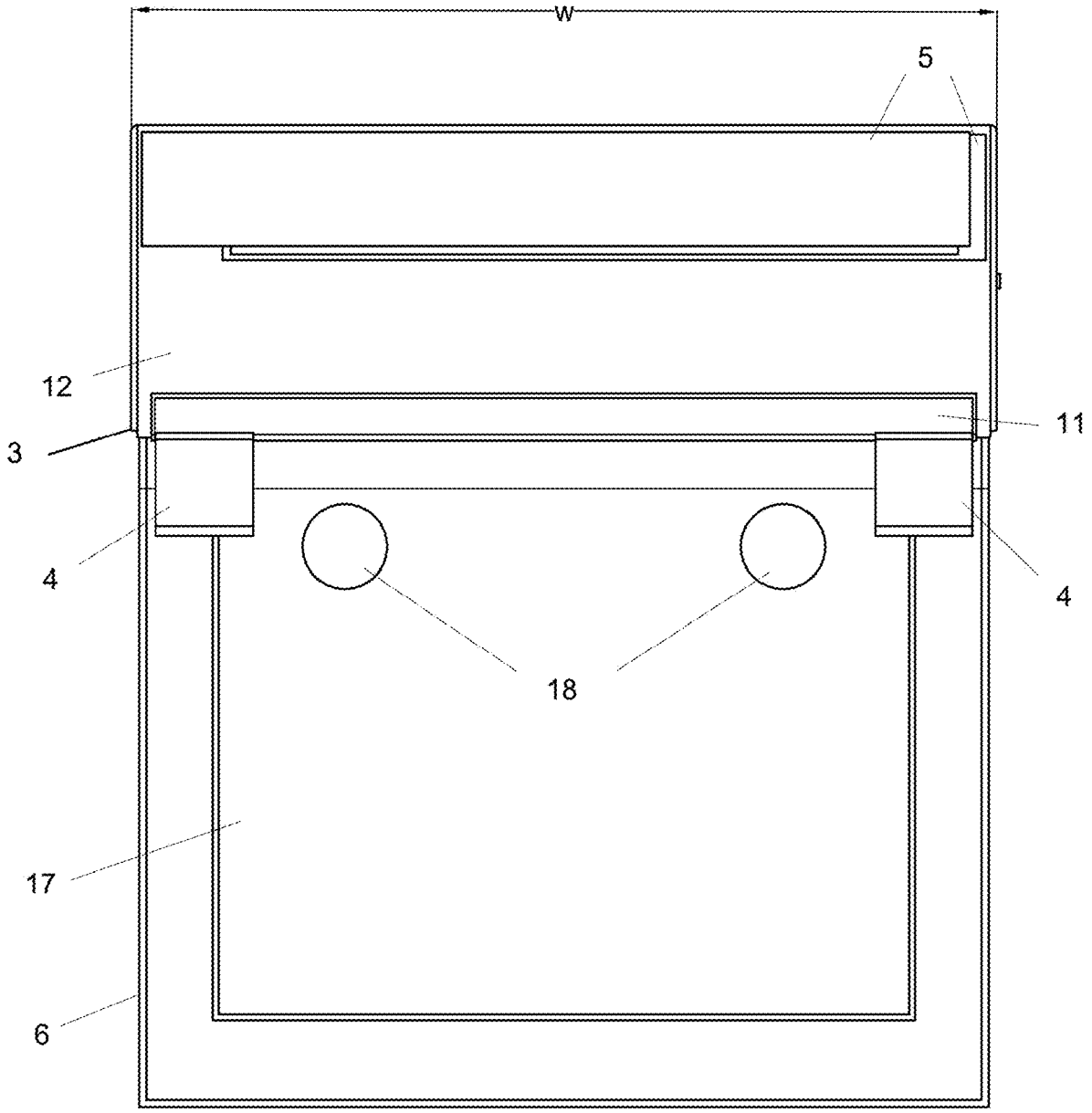
FIG. 2 is a schematic top view of the assisted abdominal sit-up device.
Figure 8:
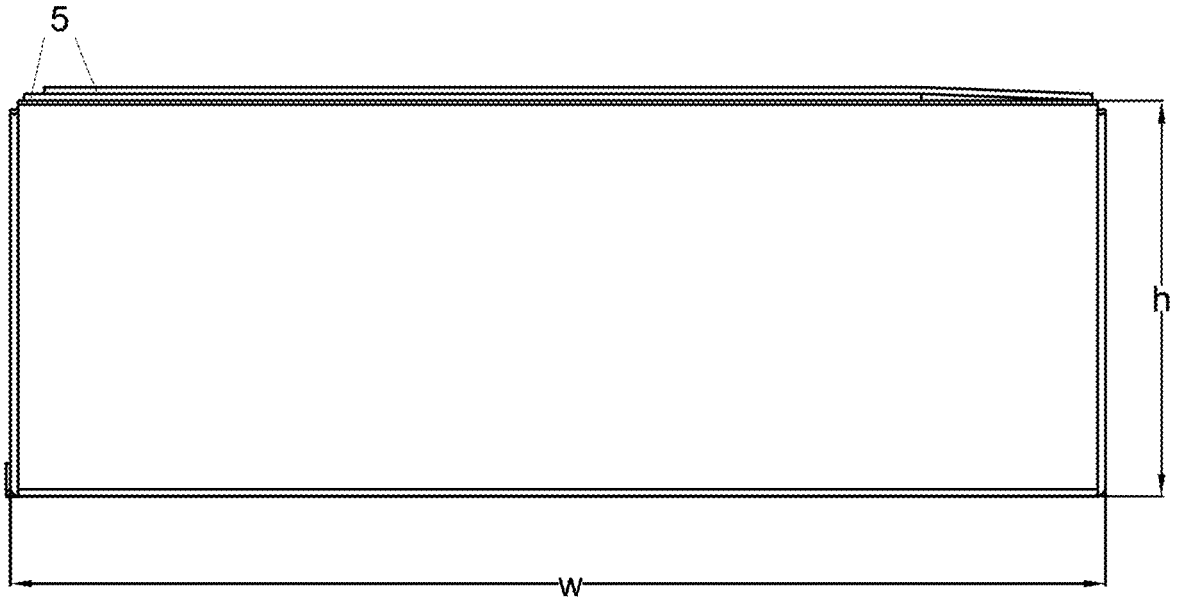
FIG. 8 is a schematic back view of the assisted abdominal sit-up device.
Figure 9:
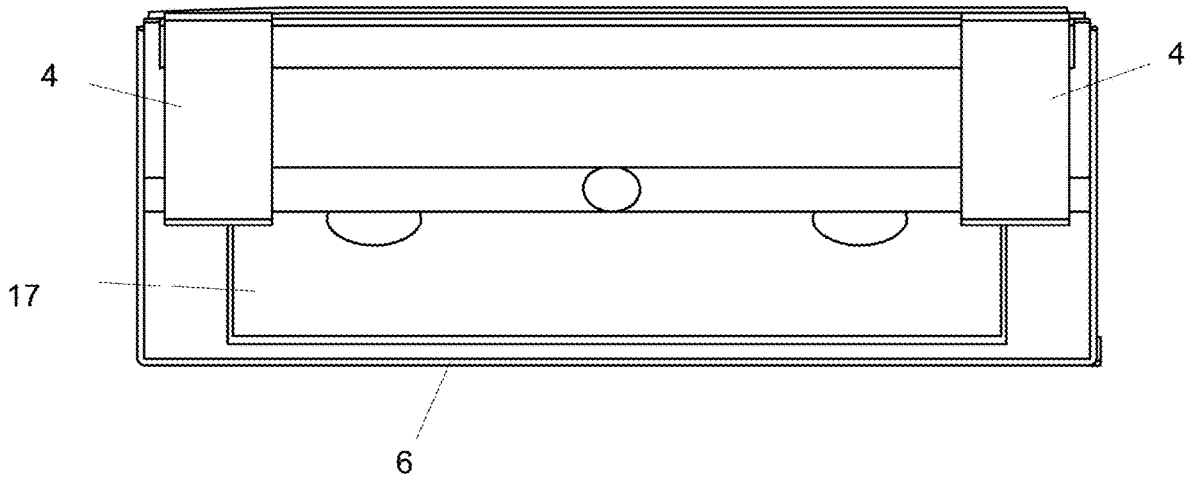
FIG. 9 is a schematic front view of the assisted abdominal sit-up device.

As shown in FIG. 2 and FIG. 8, the width (w) of the lumbosacral assist block 3 is designed to match the waist width of a person/user. Therefore, the width of the lumbosacral assist block 3 is therefore in the range of twelve inches to twenty-four inches. However, the width of the lumbosacral assist block 3 can be less than twelve inches or more than twenty-four inches. Preferably, the width of the lumbosacral assist block 3 is fifteen inches.

Figure 11:
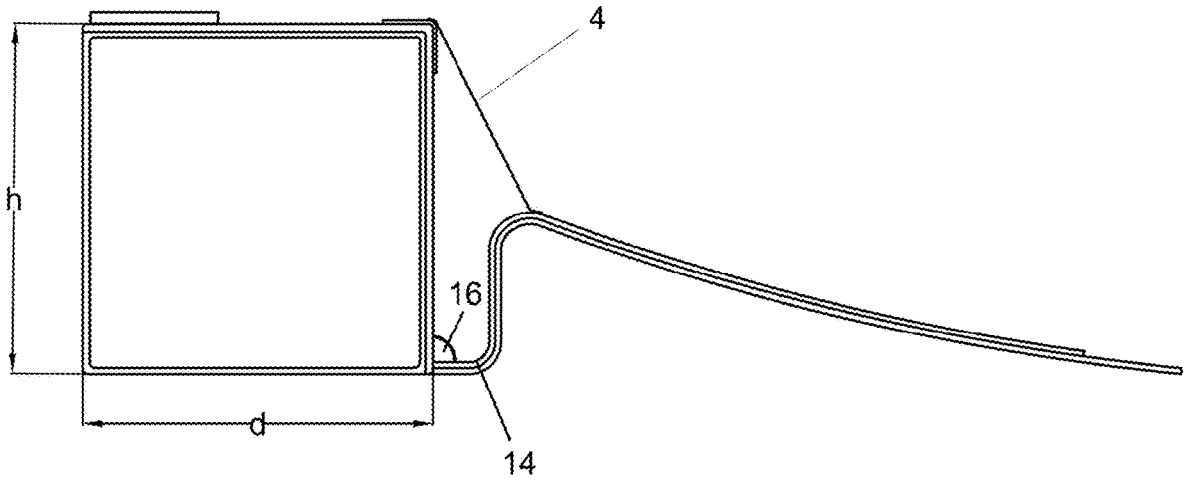
FIG. 11 is a schematic a left-side view of the assisted abdominal sit-up device.

As shown in FIG. 1 and FIG. 11, the depth (d) of the lumbosacral assist block 3 is designed to provide stability to the user when performing sit-ups. Therefore, Applicant has found that the depth of the lumbosacral assist block 3 is in the range of four inches to eight inches. Preferably, the depth of the lumbosacral assist block 3 is five inches.

As shown in FIG. 8 and FIG. 11, the height (h) of the lumbosacral assist block 3 is critical. The height of the lumbosacral assist block 3 is designed to prevent injuring the back and spine while performing sit-ups. Therefore, Applicant's assisted abdominal sit-up device 1 has solved the problem of preventing injury to the back and spine while performing sit-ups by having the height of the lumbosacral assist block 3 being the same height of a user's sacrum. Therefore, the height of the lumbosacral assist block 3 is in the range of four inches to seven inches. Applicant has discovered the height of the lumbosacral assist block 3 being six inches is the most effective height in the prevention of injuring the back and spine while performing sit-ups. Therefore, the height of the lumbosacral assist block 3 being less than three inches or more than eight inches will not support the vertebra L5 of FIG. 7 and therefore, will not prevent injury to the back and spine while performing sit-ups.

Also, the lumbosacral assist block 3 is made from a non-slip material in order to prevent the lumbosacral assist block 3 from moving on the floor or other surface when the user performs sit-ups with the assisted abdominal sit-up device 1. The non-slip material can be a polymer, any textured material or any textured coating on a material. Some specific type of polymers can be polyethylene terephthalate (PET) and polyvinyl chloride (PVC). Also, other types of polymers can be used as a non-slip material. The textured material can include ridges, burrs or any manufacturing designed geometrical or polygonal shapes in the material which creates a non-slip surface. The non-slip material of the lumbosacral assist block 3 can be made from manufacturing processes such as sewing, spinning or equivalent methods or processes.

Figure 4:
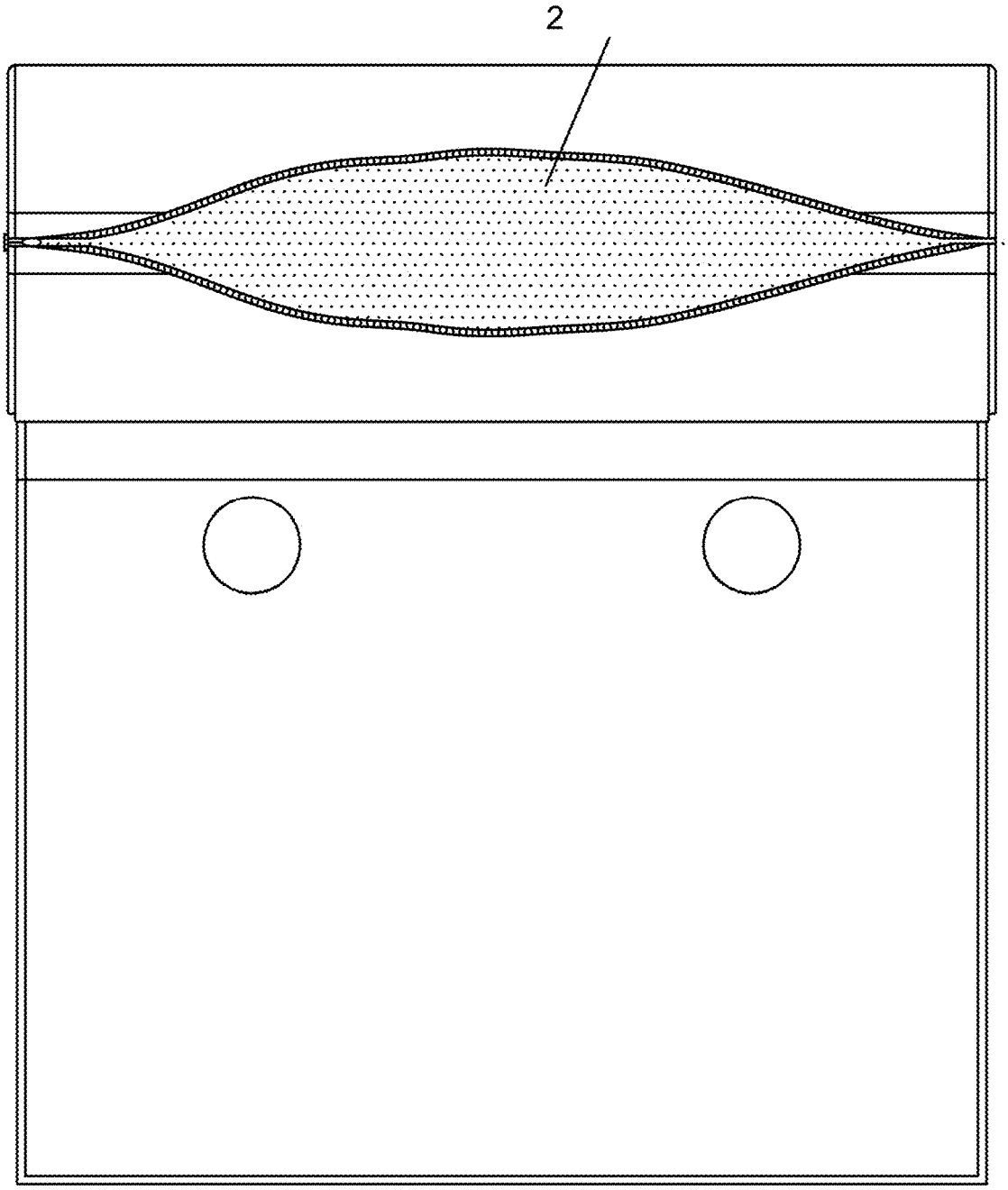
FIG. 4 is a schematic bottom view of a foam in a lumbosacral assist block.
Figure 6:
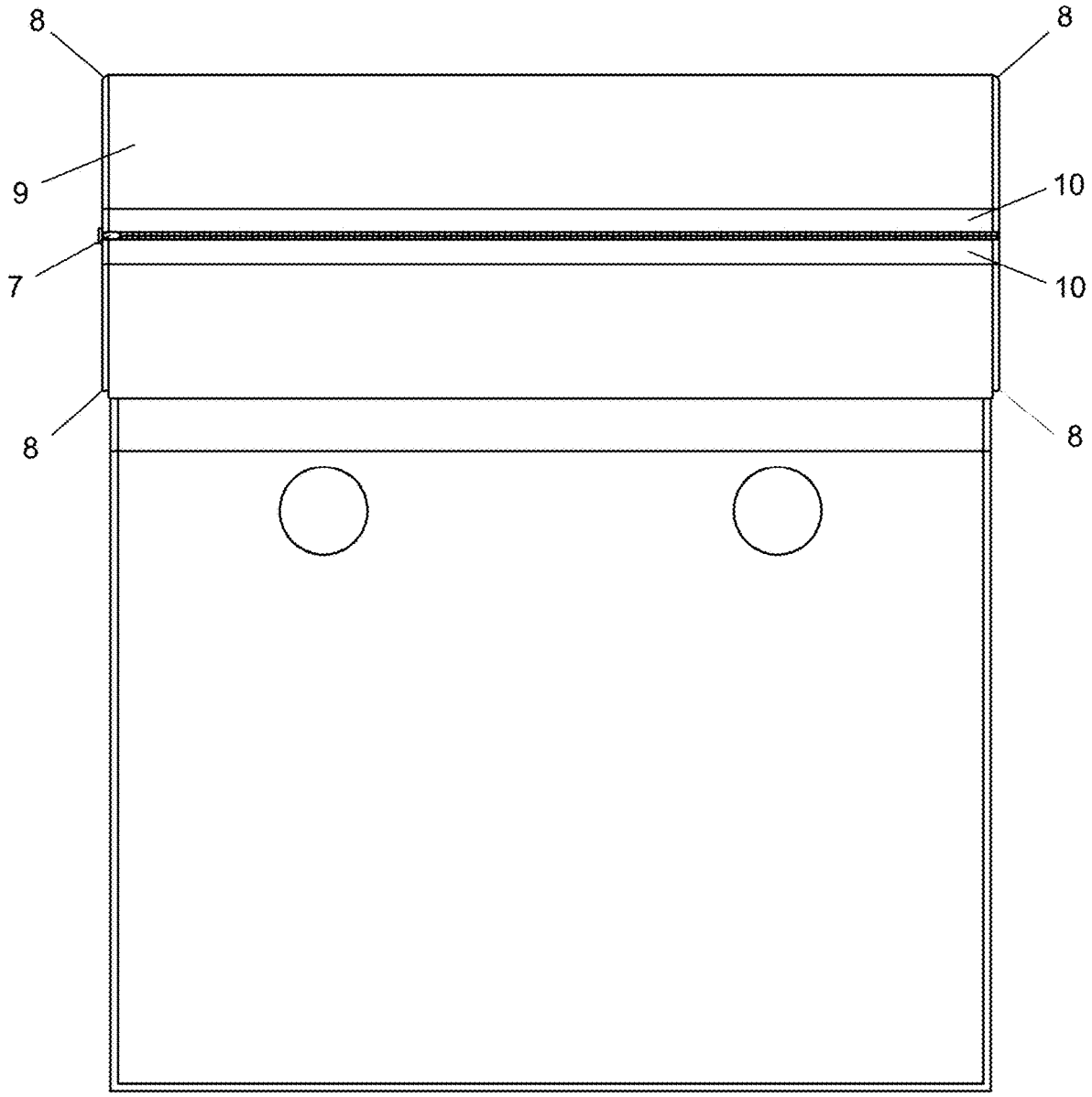
FIG. 6 is a schematic perspective bottom view of the assisted abdominal sit-up device.
Figure 10:
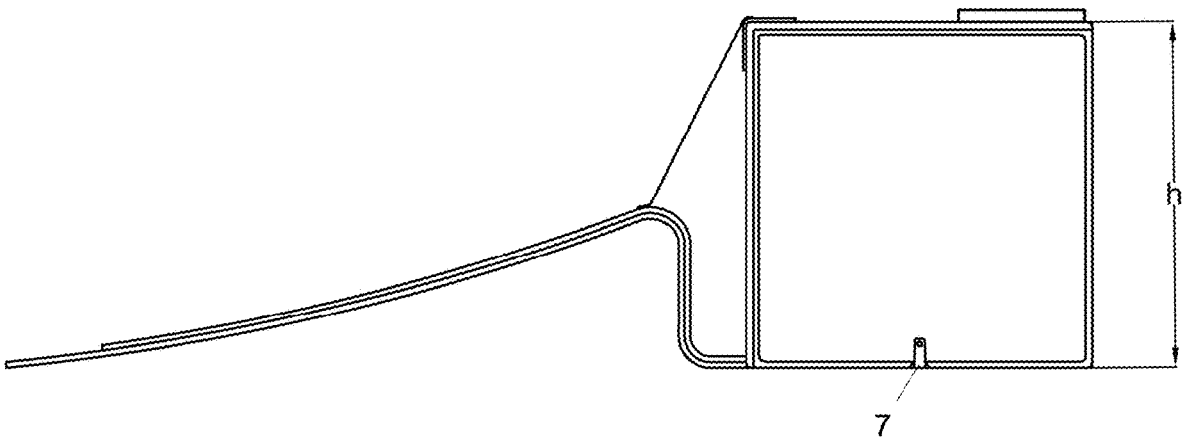
FIG. 10 is a schematic a right-side view of the assisted abdominal sit-up device.

A zipper 7 is made in the bottom of the lumbosacral assist block 3 as shown in FIG. 4, FIG. 6 and FIG. 10. The zipper is made to extend along the entire bottom length and in the middle of the lumbosacral assist block 3 in order to easily insert or remove the foam 2. However, the zipper 7 may be made to extend only along a portion of the bottom length of the lumbosacral assist block 3 and/or can be made to extend from one corner 8 to another corner 8 of the bottom part of the lumbosacral assist block 3. Flaps 10 partially cover the zipper 7 in order to protect the zipper 7 from being damaged while performing sit-ups with the assisted abdominal sit-up device 1. The flaps 10 may completely cover the zipper 7 providing protection of the zipper while a user performs sit-ups with the assisted abdominal sit-up device 1.

Figure 7:
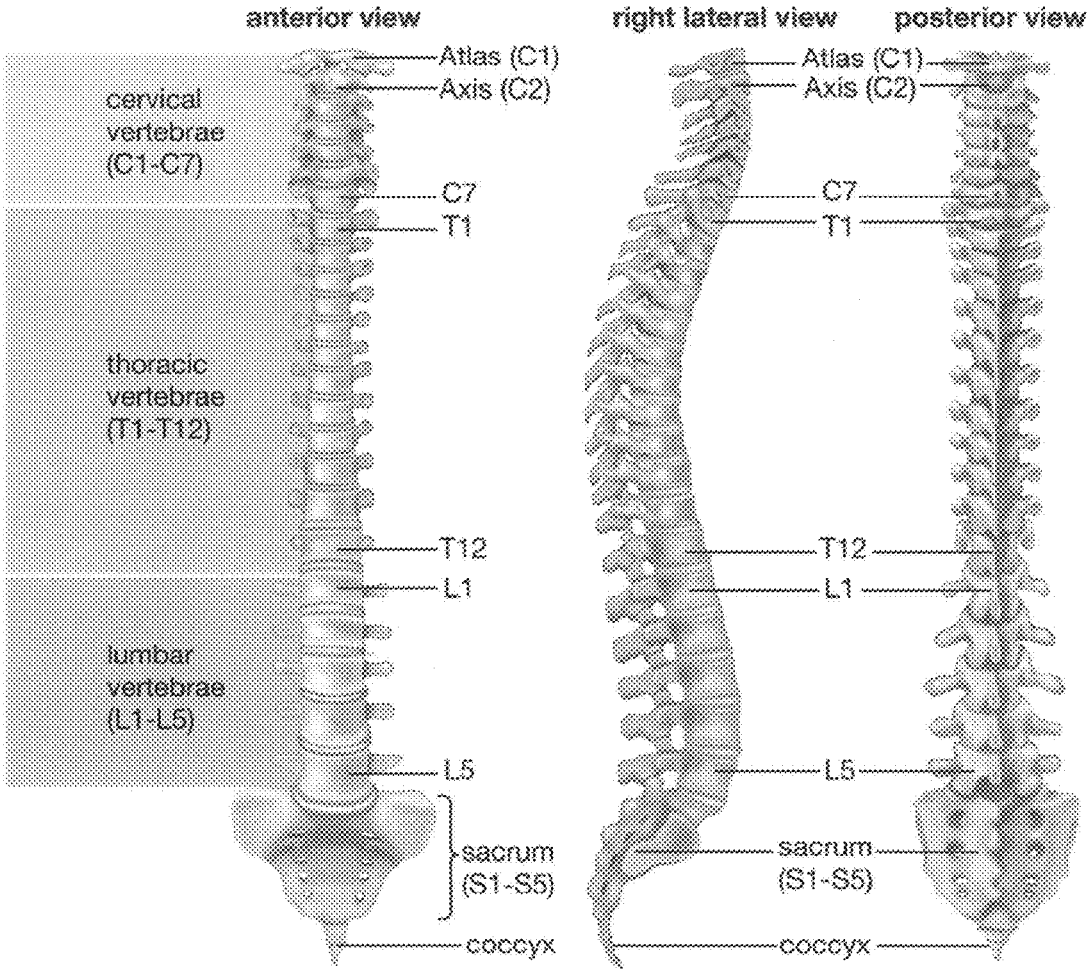
FIG. 7 is a schematic view of a human spine and sacrum.

As shown in FIG. 1 and FIG. 2, a lumbosacral pad 11 is attached to and at a front top part of to the lumbosacral assist block 3 and is located at a lumbosacral angle θ. Also, the lumbosacral pad 11 is located on a lumbar surface 12 (the top part of the lumbosacral assist block 3). The lumbosacral angle θ is a critical angle of the lumbosacral assist block 3 since the lumbosacral angle θ solves the problem of preventing injury to the back and spine when performing sit-ups because the lumbosacral angle θ of the lumbosacral assist block 3 is designed to be located at a position which the vertebra L5, as shown in FIG. 7, contacts the lumbosacral assist block 3 when performing sit-ups with the assisted abdominal sit-up device 1. The lumbosacral angle θ being 90 degrees was found to provide the best support for the vertebra L5 when performing sit-ups with the assisted abdominal sit-up device 1. In certain situations, the lumbosacral angle θ can be designed in the range of 65 degrees to 110 degrees. The lumbosacral pad 11 is sewn, glued, velcroid or equivalently attached to the lumbosacral assist block 3.

The foam 2 is preferably rectangular shaped in order to provide the user easy and safe sit-up cycles. However, the foam 2 many be any geometric shape or polygonal shape so as long as when the foam 2 is inserted into the lumbosacral assist block 3, the height of the lumbosacral assist block 3 is the same height of a user's sacrum and the assisted abdominal device 1 maintains the user's back fifteen degrees above a horizontal plane of the floor when preforming the sit-up exercises.

The foam 2 can be a memory foam and can be a foam that consists mainly of polyurethane and may also have additional additives which increases the foams viscosity and density. The foam 2 can be a viscoelastic polyurethane foam or a low-resilience polyurethane foam (LRPU). The foam cells are open, effectively creating a matrix through which air can move. Newer foams may recover more quickly to their original shape. The foam 2 can be the foam H-40 and H-50 manufactured by the Graco corporation.

The foam 2 is installed within a lumbosacral assist block (L SAB).

Additionally, various additives can be added or blended into the foaming material as necessary. For example, a coloring agent such as a pigment or the like, a chain extender, a filling material such as calcium carbonate or the like, a flame retardant, an antioxidant, an ultraviolet absorbing agent, a light stabilizer, a conductive substance such as carbon black or the like, and an antibacterial agent or the like can be blended in. The blending amount of the various additives is appropriately regulated according the different user's size, weight or other users place of use or needs.

Figure 3:
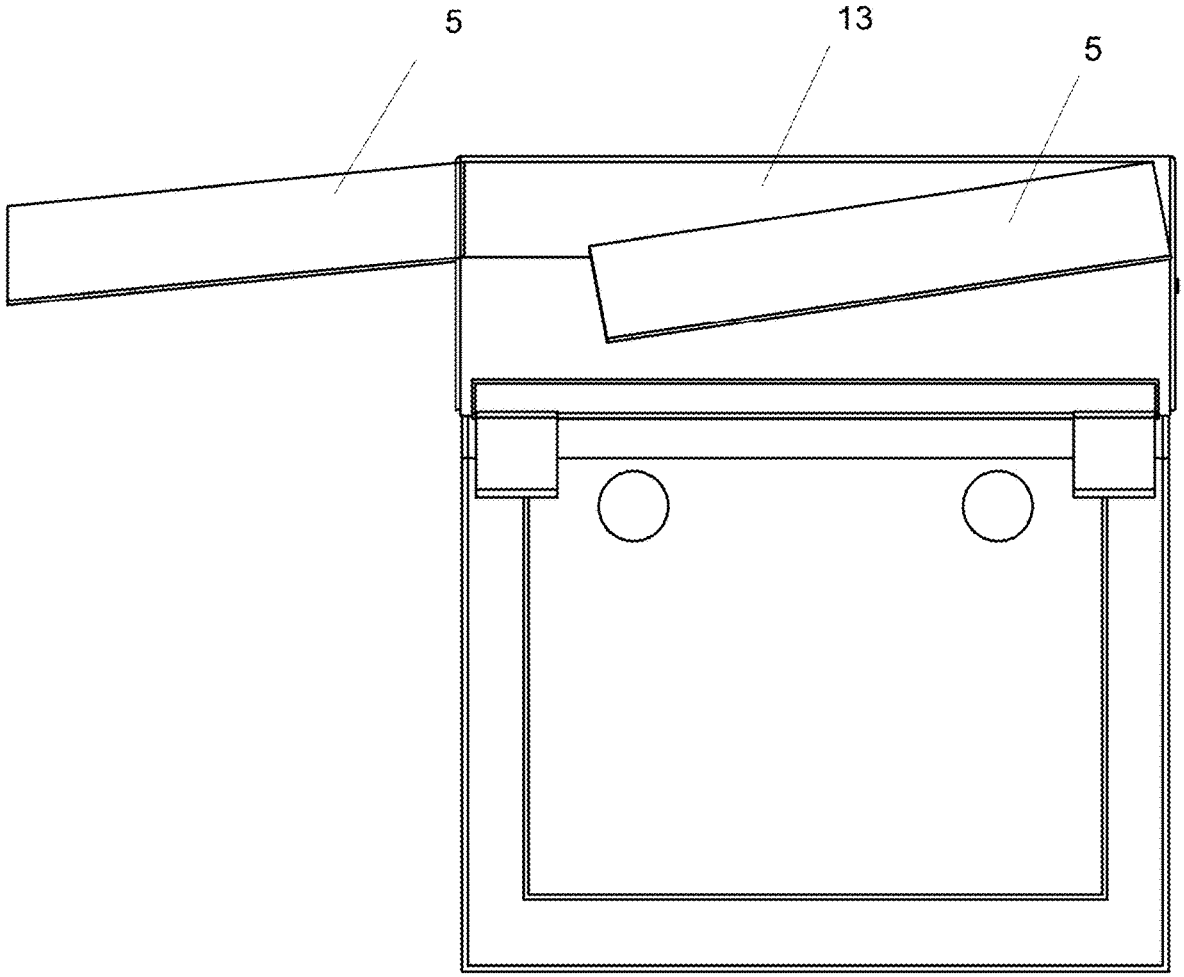
FIG. 3 is a schematic perspective view of the assisted abdominal sit-up device.

As shown in FIG. 1, FIG. 2 and FIG. 3, the lumbar surface 12 of the lumbosacral assist block 3 has a stability elastic strap 13 comprised of abdominal elastic straps 5. The stability elastic strap 13 is sewn, glued, velcroid or equivalently attached to the lumbar surface 12 of the lumbosacral assist block 3. The stability elastic strap 13 is made from an elastic material such as rubber, latex, or other flexible material that can return to its original shape after being stretched or extended when force is released.

The abdominal elastic straps 5 are formed at end portions of the stability elastic strap 13 such that the stability elastic strap 13 is attached to the lumbar surface 12 of the lumbosacral assist block 3 but the abdominal elastic straps 5 are free to be moved around since the abdominal elastic straps 5 are not fixedly secured to the lumbar surface 12 of the lumbosacral assist block 3. The abdominal elastic straps 5 wrap around a user's waist when performing sit-ups with the assisted abdominal sit-up device 1 and provides the lower back of the user being in constant and in direct contact with the lumbosacral assist block 3. The length of each of the abdominal elastic straps 5 are in the range of six inches to twelve inches. However, in some desired situations each of the abdominal elastic straps 5 can have a length less than six inches or more than twelve inches in order to be designed to accommodate the user's waist dimension. The abdominal elastic straps 5 comprise Velcro/Velcro design and the abdominal elastic straps 5 are fastened together with the Velcro/Velcro design. However, any other system or equivalent system of attaching ends together can be used. For example, the abdominal elastic straps 5 can be attached together via a belt design, which is the same belt design used with securing pants to a person's waist.

As shown in FIG. 1, FIG. 2, and FIG. 3, the hip elastic straps 4 are attached directly to the lumbosacral pad 11 at front corner sections of the lumbosacral assist block 3. The hip elastic straps 4 are sewn, glued, velcroid or equivalently attached to the lumbosacral pad 11. The attachment of the hip elastic straps 4 may be such that the hip elastic straps 4 are directly secured to the lumbosacral pad 11 and secured to the lumbosacral assist block 3. For example, attaching the hip elastic straps 4 to the lumbosacral pad 11 with sewing stiches may be such that the sewing stiches penetrate the lumbosacral assist block 3 and therefore, the hip elastic straps 4 are directly attached to the lumbosacral pad 11 and are also attached to the lumbosacral assist block 3. The hip elastic straps 4 are made from an elastic material such as rubber, latex, or other flexible material that can return to its original shape after being stretched or extended when force is released.

Figure 5:
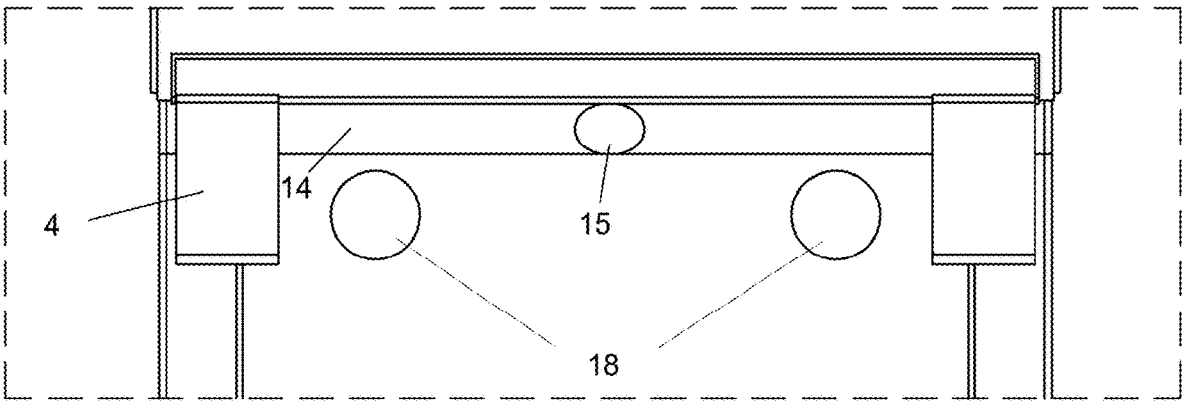
FIG. 5 is a schematic perspective view of a sacrococcygeal device, a sacrococcygeal pad, a hip pad cushion and ischial supports of the assisted abdominal sit-up device.

As shown in the bottom part of FIG. 1 and FIG. 5, a sacrococcygeal device 14 is attached to both the lumbosacral assist block 3 and a hip stability pad 6 forming an opening 16. A sacrococcygeal pad 15 is attached to the sacrococcygeal device 14. The sacrococcygeal pad 15 is critically placed in a location of the assisted abdominal sit-up device 1 where the user's coccyx (tailbone) is positioned in order to provide comfort and support of the coccyx (tailbone), prevent damage to the coccyx (tailbone), as well as to signify to the user where to sit on/in the assisted abdominal sit-up device 1. The sacrococcygeal pad 15 material is a material which is soft and provides support such as a polymer, a foam, a cushion, cotton or equivalent material. Additionally, a material which is soft and provides support such as a polymer, a foam, a cushion, cotton or equivalent material is inserted within the opening 16 of the sacrococcygeal device 14 to provide lower back and spinal support to the user when performing sit-ups with the assisted abdominal sit-up device 1. The material inserted into the opening 16 of the sacrococcygeal device 14 can be a foam, cotton, a polymer or equivalent supporting material.

As shown in the bottom part of FIG. 1, FIG. 2, FIG. 3 and FIG. 6, the hip stability pad 6 is connected to the lower part of the lumbosacral assist block 3. The hip stability pad 6 is sewn, glued, velcroid or equivalently attached to the lumbosacral assist block 3. A hip pad cushion 17 is attached to a top surface of the hip stability pad 6 with any one or a combination of the methods of sewing, gluing, velcroid or equivalently attached methods. Additionally, ischial supports 18 are attached directly to the hip pad cushion 17. The location of the ischial supports 18 are critical. The ischial supports 18 are located on the hip pad cushion 17 in a specific location for the purpose of supporting the two ischial tuberosity bones, also known informally as the sit bones. The spacing from the center of the ischial supports 18 is in the range of five inches to seven inches. In addition to the spacing of the ischial supports 18, the midpoint of the spacing is where the location of the sacrococcygeal pad 15 is positioned on the sacrococcygeal device 14 as shown in FIG. 5.

The ischial supports 18 are sewn, glued, velcroid or equivalently attached to the hip pad cushion 17. The attachment of the ischial supports 18 may be such that the ischial supports 18 are directly secured to the hip pad cushion 17 and secured to the hip stability pad 6. For example, attaching the ischial supports 18 to the hip pad cushion 17 with sewing stiches may be such that the sewing stiches penetrate the hip stability pad 6 and therefore, the ischial supports 18 are directly attached to the hip pad cushion 17 and are also attached to the hip stability pad 6.

As shown in FIG. 6, the bottom surface of the hip stability pad 6 is made from a non-slip material in order to prevent the hip stability pad 6 from moving on the floor or other surface when the user performs sit-ups with the assisted abdominal sit-up device 1. The non-slip material can be a polymer, any textured material or any textured coating on a material. Some specific type of polymers can be polyethylene terephthalate (PET) and polyvinyl chloride (PVC). Also, other types of polymers can be used as a non-slip material. The textured material can include ridges, burrs or any manufacturing designed geometrical or polygonal shapes in the material which creates a non-slip surface. The non-slip material of the hip stability pad 6 is made from manufacturing processes such as sewing, spinning or equivalent methods or processes.

The hip stability pad 6 and the hip pad cushion 17 are in the shape of a rectangle or a square or any other geometric or polygonal shape which a user can perform sit-ups when using the assisted abdominal sit-up device 1. Also, the hip stability pad 6 and the hip pad cushion 17 can be the same shape or have different shapes. For example, the hip stability pad 6 can be rectangular shaped and the hip pad cushion 17 can be a square.

In a similar manner, the ischial supports 18 and the sacrococcygeal pad 15 are in the shape of a circle but can be any other geometric or polygonal shape which supports the user's ischial tuberosity and coccyx bones when the user performs sit-ups when using the assisted abdominal sit-up device 1. Also, the ischial supports 18 and the sacrococcygeal pad 15 can be the same shape or have different shapes. For example, the ischial supports 18 can be triangular shaped and the sacrococcygeal pad 15 can be a circle. Also, one ischial support 18 can be triangular shaped, another ischial support 18 can be circular shaped and the sacrococcygeal pad 15 can be a rectangular or a circle.

Operation of the assisted abdominal sit-up device

The assisted abdominal sit-up device 1 functions as a mechanical device. The assisted abdominal sit-up device 1 aims at duplicating and assisting the functionality of the lumbosacral joint, the lower back joint between vertebra L5 and vertebra S1 as shown in FIG. 7. This lumbosacral joint affects the flexion and extension of the lower back and abdominal muscles to produce the sit-up. Flexion refers to a movement that decreases an angle between two body parts. Therefore, in the context of sit-ups, flexion is decreasing/narrowing the angle between the lower abdominal muscles and the upper thighs at the groin line. Similarly, extension refers to a movement that increases an angle between two body parts. Therefore, in the context of sit-ups, extension is increasing/widening the angle between the lower abdominal muscles and the upper thighs at the groin line.

The abdominal assisted device comprises a foam in a lumbosacral assist block. When the user extends (stretches) his/her back and abdominal muscles, the foam of the lumbosacral assist block will be compressed and therefore stores energy, due to the pressure exerted on the foam by the lower back muscles during the extension phase of the sit-up cycle. When the user flexes his/her lower back and abdominal muscles, (to narrow the angle between the lower abdominal muscles and the upper thighs at the groin line) pressure is released from the compressed foam of the lumbosacral assist block to the lower back and the released pressure exerts force/pressure on the lower back assisting the rise of the lower back and assisting the lower abdominal muscle in the flexion phase of the sit-up cycle. This is similar to a personal trainer assisting the user to rise up from a recumbent position to a sitting position. This mechanical energy stored and then released from the foam makes performing the sit-up much easier.

The abdominal assisted device additionally comprises hip elastic straps and abdominal elastic straps to augment the mechanical assisting value of the abdominal assisted device. During the extension phase of the sit-up cycle, the hip elastic straps become extremely stretched and therefore stores energy. When the pressure is released from the hip elastic straps during the flexion phase of the sit-up cycle, the stored energy will be released from the hip elastic straps to the user's lower back assisting the user to complete the sit-up cycle. During the extension phase of the sit-up cycle, the abdominal elastic straps keep the lumbosacral assist block in close contact with the lower back of the user. When the user's lower back rises up from the floor or another surface during the flexion phase of the sit-up cycle, the lumbosacral assist block stays in direct contact with the lower back of the user. Hence, the mechanical preservation of energy storage and energy release improves and maximizes the efficiency of the mechanical value of the abdominal assisted device.

The lumbosacral assist block is a highly specific elastic foam block designed with a foam of a specific elasticity and density that allows the block to function as a kinetic energy reservoir unit. The lumbosacral assist block will store kinetic energy during the extension (stretch) phase of the sit-up cycle (a pro-gravity phase of the motion cycle). This stored kinetic energy in the compressed lumbosacral assist block will be released to assist and augment the user's power to be able to initiate the abdominal flexion phase of the sit-up cycle. The abdominal flexion phase of the sit-up cycle is the most difficult phase of the sit-up cycle because the initial abdominal flexion phase of the sit-up cycle is anti-gravity in nature and requires the user to exert a lot of kinetic energy to be able to overcome gravity (that is pulling himself/herself up). Most users lack this amount of anti-gravity kinetic energy. Therefore, the abdominal assisted device provides sufficient anti-gravity kinetic energy needed to affect the abdominal flexion phase of the sit-up cycle and the lumbosacral assist block releases its stored kinetic energy and expands to assist the user in overcoming gravity and affects the abdominal flexion phase of the sit-up cycle.

The hip stability pad adapts perfectly to the anatomy of the human pelvis. The hip stability pad provides stability and cushioning during the performance of the sit-up cycle. The coccygeal support corresponds to the coccyx (tailbone) of an individual and provides cushioning and stability of the user during sit-up cycles. Ischial supports correspond to the ischial tuberosities of the user and provide cushion and stability. The use of the hip stability pad will allow optimal performance of the sit-up cycle and prevent any unnecessary loss of the kinetic energy. This will keep the sit-up cycle as mechanically efficient as possible.

Finally, it should be noted that the above embodiments are only used to illustrate the technical aspects of the present disclosure, rather than limit the embodiments. Although the present disclosure has been described in detail with reference to the foregoing embodiments, it should be understood by a person of ordinary skill in the art that the technical aspects described in the embodiments can still be modified or equivalent substitutions can be made to some or all of the technical features and the modifications or substitutions would not change the substance of the scope of the embodiments of the present disclosure.

What is claimed is:

1. An assisted abdominal sit-up device comprising a deformable material in a lumbosacral assist block, a hip stability pad attached to the lumbosacral assist block and at least one hip elastic strap attached to the hip stability pad and the lumbosacral assist block; wherein a height of the lumbosacral assist block is a same height as a human sacrum.

2. The assisted abdominal sit-up device according to claim 1, wherein the deformable material is foam in the lumbosacral assist block and the foam is compressed and stores energy when a user extends his/her lower back and contacts the lumbosacral assist block during an extension phase of a sit-up cycle and the foam of the lumbosacral assist block releases the stored energy and exerts a force on the lower back assisting a rise of the lower back and assisting lower abdominal muscles in a flexion phase of the sit-up cycle.

3. The assisted abdominal sit-up device according to claim 1, wherein the deformable material of the lumbosacral assist block is rectangular shaped.

4. The assisted abdominal sit-up device according to claim 1, wherein the hip stability pad is attached to a lower part of the lumbosacral assist block.

5. The assisted abdominal sit-up device according to claim 1, wherein a bottom surface of the hip stability pad is made from a non-slip material in order to prevent the hip stability pad from moving on a floor or other surface when a user performs sit-ups with the assisted abdominal sit-up device.

6. The assisted abdominal sit-up device according to claim 1, wherein the lumbosacral assist block is made from a non-slip material in order to prevent the lumbosacral assist block from moving on a floor or other surface when a user performs sit-ups with the assisted abdominal sit-up device.

7. The assisted abdominal sit-up device according to claim 1, wherein a zipper is formed in a bottom of the lumbosacral assist block.

8. The assisted abdominal sit-up device according to claim 1, further comprises a stability elastic strap, where the stability elastic strap comprises abdominal elastic straps and the abdominal elastic straps wrap around a user's waist and are fasten together in order to accommodate a dimension of the user's waist.

9. The assisted abdominal sit-up device according to claim 1, wherein a stability elastic strap is attached to a top of the lumbosacral assist block.

10. The assisted abdominal sit-up device according to claim 1, wherein a sacrococcygeal device is attached to a lower part of the lumbosacral assist block and comprises an opening.

11. The assisted abdominal sit-up device according to claim 10, wherein a support material is provided within the opening of the sacrococcygeal device.

12. The assisted abdominal sit-up device according to claim 11, wherein a sacrococcygeal pad is attached to the sacrococcygeal device.

13. The assisted abdominal sit-up device according to claim 12, wherein the sacrococcygeal pad is attached at a location on the sacrococcygeal device where a user's coccyx will be placed on the assisted abdominal sit-up device when the user performs sit-ups with the assisted abdominal sit-up device.

14. The assisted abdominal sit-up device according to claim 1, wherein a lumbosacral angle θ is formed on the lumbosacral assist block and is located on the lumbosacral assist block at a position where a vertebra L5 contacts the lumbosacral angle θ when a user performs sit-ups with the assisted abdominal sit-up device.

15. The assisted abdominal sit-up device according to claim 14, wherein the at least one hip elastic strap is directly attached to the lumbosacral pad and the lumbosacral angle θ is 90 degrees.

16. An assisted abdominal sit-up device comprising a deformable material in a lumbosacral assist block, a hip stability pad attached to the lumbosacral assist block and at least one hip elastic strap attached to the hip stability pad and the lumbosacral assist block wherein a hip pad cushion is attached to a top side of the hip stability pad.

17. The assisted abdominal sit-up device according to claim 16, wherein ischial supports are attached directly to the hip pad cushion.

18. The assisted abdominal sit-up device according to claim 17, wherein the ischial supports have a spacing from a center of the ischial supports in the range of five inches to seven inches in order to support two ischial tuberosity bones of a user of the assisted abdominal sit-up device.

19. An assisted abdominal sit-up device comprising a deformable material in a lumbosacral assist block, a hip stability pad attached to the lumbosacral assist block and at least one hip elastic strap attached to the hip stability pad and the lumbosacral assist block wherein a lumbosacral pad is attached to the lumbosacral assist block.

* * * * *